United States Patent [19]

Eckert et al.

[11] 4,392,888

[45] Jul. 12, 1983

[54] METAL TREATMENT SYSTEM

[75] Inventors: Charles E. Eckert, Plum Boro; Ronald E. Miller, Murrysville, both of Pa.

[73] Assignee: Aluminum Company of America, Pittsburgh, Pa.

[21] Appl. No.: 337,529

[22] Filed: Jan. 7, 1982

[51] Int. Cl.³ ..... C22B 21/06

[52] U.S. Cl. ..... 75/68 R; 75/93 E

[58] Field of Search ..... 75/68 R, 93 E, 68 A, 75/93 R, 93 AC

[56] References Cited

U.S. PATENT DOCUMENTS

| | | | |
|---|---|---|---|
| 1,998,467 | 4/1935 | Stroup | 75/58 |
| 3,149,960 | 9/1964 | Robinson, Jr. | 75/68 |
| 3,650,730 | 3/1972 | Derham | 75/68 |
| 3,839,019 | 10/1974 | Bruno et al. | 75/68 R |
| 3,854,934 | 12/1974 | Dore et al. | 75/68 R |
| 3,972,709 | 8/1976 | Chia et al. | 75/68 R |
| 3,975,187 | 8/1976 | Kibby | 75/93 E |

FOREIGN PATENT DOCUMENTS

| | | | |
|---|---|---|---|
| 999145 | 11/1976 | Canada | 75/68 R |
| 2841039 | 4/1980 | Fed. Rep. of Germany | 75/68 R |
| 712900 | 8/1954 | United Kingdom | 75/68 R |

*Primary Examiner*—M. J. Andrews

*Attorney, Agent, or Firm*—Carl R. Lippert

[57] ABSTRACT

Molten aluminum or other metals are purified by contacting with a fluorocarbon, such as $CCl_2F_2$, in order to decrease the amount of impurity metal elements along with gas and inclusions therein preferably in the presence of an agitator to enhance efficiency. An oxidizer, such as oxygen, is employed to prevent the carbon in the fluorocarbon from forming carbide inclusions. Oxidizing the carbon to carbon monoxide is preferred in treating aluminum since the monoxide effectively removes the carbon from the system without oxidizing aluminum. Preferably, a fluorine acceptor is employed to temporarily combine with the fluorine in the fluorocarbon and prevent it from reacting with carbon such that the fluoride is still available to treat the molten metal. The gases employed to treat the molten metal can be passed over a bed of carbon immediately prior to introduction into the melt. The system operates with low skim generation and without providing a salt cover and is capable of substantially fume-free operation.

38 Claims, 1 Drawing Figure

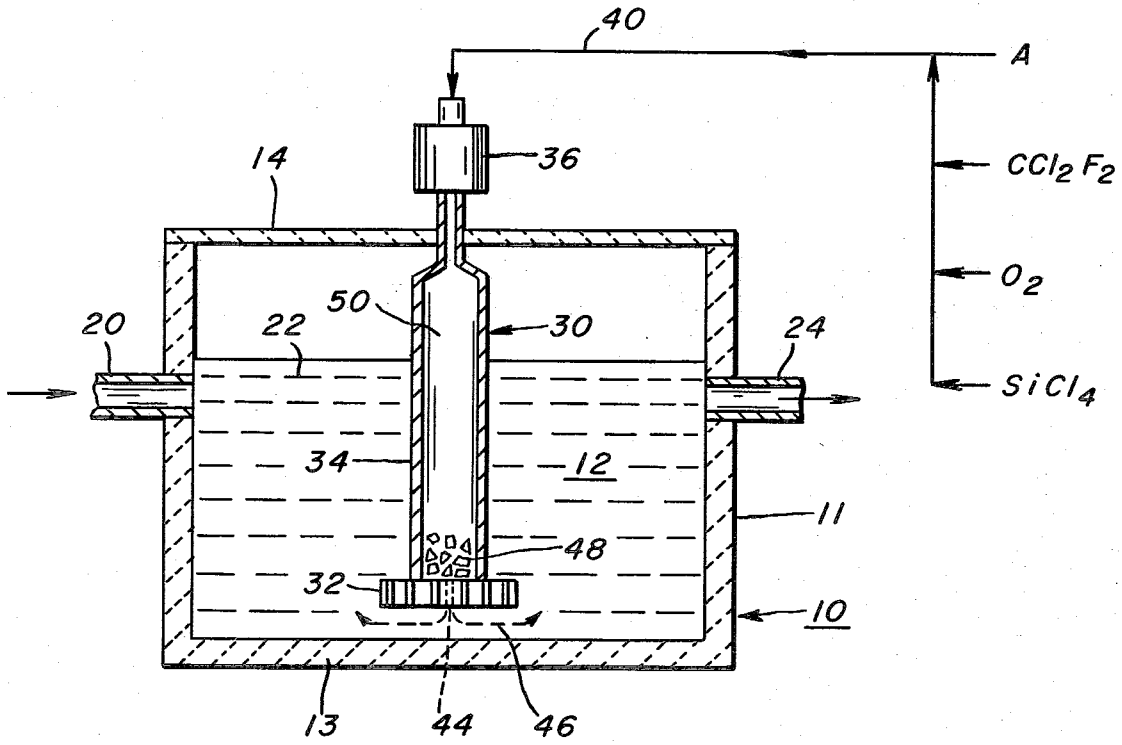
A
$CCl_2F_2$
$O_2$
$SiCl_4$
40
36
24
30
12
11
10
48
46
44
50
34
32
13
14
22
20

METAL TREATMENT SYSTEM

BACKGROUND

This invention relates to a method for treating a molten metal, such as aluminum or aluminum alloy, to remove trace element impurities and gas and solid impurities therefrom.

Molten metal, such as aluminum, including alloys containing over 50% aluminum, often contains gas and solid impurities, such as dissolved hydrogen and aluminum oxides. Molten aluminum also typically contains alkali and alkaline earth elements such as about 0.002 wt.% Na or 0.001 wt.% Ca, or both. A number of processes have been employed to purify the metal using a gas containing chlorine, such as a mixture of argon and chlorine. Such a process is described in U.S. Pat. No. 3,839,019, incorporated herein by reference. One problem sometimes encountered as processes using chlorine treatment are pressed for increased productivity is that difficulties can be encountered in separating the salts formed as chlorine reaction products, which salts are largely liquid in character. These salts can be difficult to separate and can be carried by the molten aluminum to the casting station and result in surface and subsurface defects in the cast ingot, such as oxide patches which, in turn, can give rise to problems in rolling the ingot into plate or sheet products. Since the oxide patch problem is believed to be associated with the liquid salt reaction products formed by reacting chlorine with metal, such as magnesium, present in the aluminum, it has been proposed to employ reactive fluorine compounds, such as fluorocarbons, since the fluoride reaction products are predominantly solid and do not present the same separation problems as liquid salt products. Hence, fluorocarbons, such as dichlorodifluoromethane ($CCl_2F_2$), have been employed in treating molten aluminum with a reactive gas to reduce the amounts of gas impurities and oxides, along with impurity elements such as sodium and calcium. U.S. Pat. No. 3,854,934, incorporated herein by reference, is an example disclosing use of fluorocarbons for treating molten aluminum under a supernatent salt cover. Even though $CCl_2F_2$ contains chlorine, the presence of the fluoride salt reaction products tends to tie up the chloride reaction products into fluoride-chloride complexes which behave as solids and are relatively easy to separate from the molten metal. One problem with fluorocarbons, a readily available volatile fluoride source, is that they necessarily contain carbon. While the chlorine and fluorine values are consumed by reacting with impurities in molten aluminum, the carbon reacts with aluminum to form aluminum carbide, which forms an inclusion. Thus, the fluorocarbon treating processes intended to remove trace elements, gas and oxides can tend to do so at the expense of adding an additional impurity; namely, aluminum carbide as an inclusion impurity. This has somewhat hindered acceptance of the fluorocarbon treatment in high volume applications.

SUMMARY OF THE INVENTION

In accordance with the invention, molten aluminum or other metal can be treated with fluorocarbons or even fluorine-free halocarbons wherein the carbon content of the halocarbon is oxidized to a form which won't decompose or harm the metal being treated. In the case of treating molten aluminum, the carbon preferably is oxidized by oxygen to the carbon monoxide form (CO) since carbon dioxide can be reduced by molten aluminum to produce an aluminum oxide product which is detrimental to the aluminum melt. Surprisingly, adding the correct amount of oxygen, normally considered detrimental to aluminum, beneficiates the process of treating molten aluminum with a halocarbon.

Where the halocarbon contains fluorine, it is preferred to employ a fluorine acceptor to prevent $CF_4$ from entering the melt while preserving fluorine values available for reaction in the molten metal to fluoridize fluoridizable dissolved metal impurities such as sodium, calcium and magnesium.

DETAILED DESCRIPTION

In this description reference is made to the drawing in which:

The FIGURE is a schematic cross-sectional elevation depicting operation in accordance with the improvement.

Referring now to the FIGURE, the system 10 includes a treatment chamber 12 contained within walls 11 and bottom 13 in refractory material. A lid 14 is provided to cover the chamber 12 and the body 22 of molten metal contained therewithin. Molten metal continuously enters through inlet 20 and exits through outlet 24. Within the treatment chamber 12 is situated agitator system 30 comprising a turbine-type agitator 32 supported by a rotating shaft 34 rotated by motor 36. The agitator 32 and shaft 34 are suitably in graphite. The shaft is hollow or provided with a conduit therethrough to provide a path for gases entering through gas supply 40, the gas exiting the shaft and entering the melt through a hole 44 in the bottom of agitator blade 32 such that the gas enters the melt as shown by arrows 46. The hollow conduit 50 in the rotating shaft 30 is preferably substantial in internal volume to provide a slow gas flow path so that the gases are heated to sufficient temperature for the reaction with the halocarbon to occur and to provide adequate time for that reaction to proceed. For the halocarbons typically used in treating molten metals, a temperature of 1300° F. is adequate to react the carbon therein with oxygen. Aluminum is typically treated at temperatures of 1350° to 1400° F. which facilitates reaching adequate reaction temperature. Also, it is preferred to allow substantial space for a material, such as bed 48 of crushed carbon anode material, to be positioned near the gas outlet for reasons explained hereinbelow. Molten metal exiting through exit 24 can be moved through settling chambers or separation chambers to allow the solid fluoride salt complexes to settle upwardly out of the melt or to be removed by filtration or other means, it being remembered that the fluoride-containing salts are either solid or sufficiently solid to behave like solids and can be removed by filtration or any other convenient means in contrast to liquid salts which can create significantly more difficult separation problems.

Various halocarbons can be used in practicing the invention which will benefit the treatment of molten metal with fluorocarbons, even halocarbons free of fluorine, for instance carbon tetrachloride, since much the same problem in preventing the carbon from reacting in a deleterious fashion applies whether or not the halocarbon contains fluorine. For instance, in treating molten aluminum, the carbon reacts with aluminum to form inclusions of aluminum carbide which tends to compromise the purpose of fluxing in the first place.

However, a primary advantage in practicing the invention applies to the use of fluorocarbons since one purpose thereof is to eliminate essentially liquid chloride salt phases and produce salt phases containing fluorides which behave like solids which form at temperatures less than 1600° F. such as are used for treating aluminum and are, hence, easier to remove or separate from the molten metal being treated. The fluorocarbons largely concerned are the fully halogenated lower hydrocarbons containing one to five or six carbon atoms, such as the halomethanes (one carbon atom) and the haloethylenes or haloethanes (two carbon atoms). It is preferred that the halocarbons be fully halogenated since, at least in treating molten aluminum, the introduction of hydrogen is undesirable since one of the purposes of fluxing is to remove hydrogen. Suitable halocarbons are listed below:

| | |
|---|---|
| dichlorodifluoromethane | $CCl_2F_2$ |
| trichlorofluoromethane | $CCl_3F$ |
| monochlorotrifluoromethane | $CClF_3$ |
| carbon tetrafluoride | $CF_4$ |
| hexafluoroethane | $C_2F_6$ |
| dichlorotetrafluoroethane | $C_2Cl_2F_4$ |

Of these, dichlorodifluoromethane ($CCl_2F_2$), trichlorofluoromethane ($CCl_3F$) and dichlorotetrafluoroethane ($C_2Cl_2F_4$) are preferred. These compounds are available under the trade designation Freon.

When desired, the halocarbon can be accompanied by a halogen such as chlorine and hence the reactive gases employed in practicing the invention can include various combinations comprising a halocarbon, although in some instances it may be preferred to supply substantially all the reactive gas as halocarbons.

In practicing the invention, it also is often advisable to employ an inert or at least nonreactive gas such as argon. The inert gas serves to help distribute the reactive gases, such as chlorine and fluorine compounds, throughout the melt and provide increased liquid-gas contact area while utilizing a minimum amount of reactive gases, the inert gases in some respects serving as a carrier gas. When referring to the inert gases, it is intended to refer to the inert gases from Group Zero including helium, neon, argon, krypton, xenon and radon. In a broader sense, the improvement utilizes other diluent or carrier gases which are nonreactive with the molten metal being treated or at least do not react in a deleterious fashion or harm the metal being treated or excessively or undesirably impede the desired results. For instance, in treating molten aluminum, carbon monoxide could be employed as a nonreactive gas, although argon is a preferred gas because of its present availability and ease of handling.

The amount of the nonreactive gas compared to the halocarbon gas is about 50% to in excess of 99% carrier gas, i.e. from less than 1% to typically not more than 50% of the halogen-containing gas. In treating molten aluminum, the amount of halogenaceous gas can be under 20% and typically in the range of about ½ to 10%, with the nonreactive gas ranging from about 90 to about 99½%. That is, in treating molten aluminum, the amount of nonreactive or carrier gas exceeds the halocarbon by a ratio of 2:1 to greater than 9:1 or 10:1.

Various oxidizers for oxidizing the carbon in the halocarbon can be employed in practicing the invention, and the term "oxidizer" is intended in the broad sense; that is, of taking or accepting electrons, and more specifically in the sense involving oxygen. The preferred oxidizer is oxygen itself in the case of treating aluminum. Oxygen can oxidize carbon to the monoxide (CO) or dioxide ($CO_2$), although it is significant that the dioxide is capable of reduction in molten aluminum to form carbon monoxide and aluminum oxide, an inclusion. Hence, it is desirable to largely limit the oxidized carbon to carbon monoxide since such results in virtually no damage to the treatment of molten aluminum. As is known, the oxidation of carbon to carbon monoxide proceeds according to the following reaction:

$$C+\tfrac{1}{2}O_2 \rightarrow CO$$

Thus, on a stoichiometric basis, one-half mole of oxygen will react with one mole of carbon to produce one mole of carbon monoxide. However, in practicing the invention, it is preferred to use an excess over the oxygen stoichiometrically required to produce carbon monoxide, such as an excess of 10 to 30%, preferably around 20%, in order to be sure that all carbon is reacted to an oxidized form, but not in excess of that which would oxidize all of the carbon to $CO_2$. One consequence of such an excess would be to introduce oxygen itself into the molten metal and, in the case of treating molten aluminum, such would consume substantial amounts of the aluminum which would react almost instantaneously with any oxygen available. A further consequence could be to oxidize a carbon graphite agitator shaft if such is employed as shown in the FIGURE.

It is also desirable that the halocarbon be oxidized prior to its introduction into the molten metal bath itself especially where the molten metal treated reacts with the oxidizer. For instance, in the case of treating molten aluminum, introducing the halocarbon into the melt separately from the oxygen would simply result in the oxygen being quickly converted to aluminum oxide. The reaction of most of the lower halocarbons with oxygen proceeds at temperatures in the range of about 900° F. and higher and proceeds more rapidly at the temperatures of 1300° or 1350° F. which prevail in the conduit 50 of shaft 34 in treating molten aluminum. Since it is preferred to use some excess of oxygen over that required stoichiometrically to convert carbon to carbon monoxide, it is likewise preferable to reduce the small amount of carbon dioxide thereby formed by use of porous carbon or a small carbon bed 48 at the bottom of channel 50 in the agitator shaft 34 so as to reduce the $CO_2$ to CO by the action of the carbon. The carbon bed can be but a few inches thick and provided from crushed anode material from Hall electrolytic cells used in producing aluminum. While oxygen is a preferred oxidizer, other oxidizers such as $N_2O$, $B_2O_3$, $SiO_2$, $Na_4B_2O_5$ and others can be employed, although oxygen, because of its availability and cost, is often preferred. The oxidizer preferably should produce gas or vapor oxidation products or other oxidation products either easily removed or not harmful to the metal being treated. In a still broader sense, it is believed that reacting the carbon in the halocarbon even by reactions other than oxidation may be feasible to form carbonaceous products or compounds more stable than the halocarbon but not deleterious to the molten metal being treated, said reaction occurring before introducing the halocarbon into the molten metal.

While the oxidation or reaction of the carbon in a halocarbon can proceed as outlined above with good results, where the halocarbon contains fluorine it is preferable to employ a fluorine acceptor to prevent $CF_4$ from entering the melt. Carbontetrafluoride, a rather stable compound, effectively consumes the fluorine values to impede treatment of the metal by the fluorine and can introduce $Al_4C_3$ as an inclusion. Silicon and boron are effective fluorine acceptors, with silicon being preferred as relatively inexpensive and easy to handle. One suitable source of silicon is silicon tetrachloride, and a preferred embodiment of the invention utilizes silicon tetrachloride as a source of silicon to provide a fluorine acceptor during oxidation of the fluorinated hydrocarbon. While silicon and boron are described as suitable fluorine acceptors, at least in treating molten aluminum under the conditions most often there used, for instance 1350° F., other fluorine acceptors may be used in treating molten aluminum or other metals in accordance with the following guidelines. A first requisite for the fluorine acceptor is that its fluoride should be more stable than $CF_4$ in order for it to effectively prevent or reduce the formation of $CF_4$. However, the fluoride of the fluorine acceptor preferably should be less stable than the respective fluorides of the molten metals involved in the treatment. For instance, in treating molten aluminum, the fluorine acceptor's fluoride should be less stable than $AlF_3$, $MgF_2$, NaF, $CaF_2$ and LiF. This enables the temporary fluoride formed by the fluorine acceptor to be reduced by those metals, especially the impurity metals, in the molten metal being treated.

Another desirable characteristic of the fluorine acceptor is that its fluoride should be more stable than its own oxide so as to avoid formation of oxides. Still another desirable characteristic of the fluorine acceptor is that its fluoride should be a vapor or at least a liquid under the conditions of molten metal treatment so that is can be readily transferred into the treatment zone. Thus, the acceptor's fluorides preferably should not be solid and are preferably vaporous. The use of silicon tetrachloride, which is preferred as a fluorine acceptor in treating molten aluminum, forms silicon tetrafluoride and chlorine, the former being reduced to silicon in the molten metal treatment process. The amount of the fluorine acceptor employed is relatively small, as is the amount of the halocarbon employed, such that the amount of silicon introduced into molten aluminum in practicing the invention by reduction of silicon tetrafluoride is relative miniscule, typically amounting to less than 0.01 wt.%.

In the embodiment depicted in the FIGURE, argon, $C_2CL_2F_2$, $O_2$ and $SiCl_4$ are shown as simply being commingled prior to introduction to the conduit 50 within the agitator shaft 34. The $SiCl_4$ is liquid at room temperature but quickly vaporizes upon ingestion into the moving stream of argon, $O_2$ and $C_2Cl_2F_2$. As already indicated, the amount of the halocarbons is relatively small in comparison with the nonreactive gas and the amount of oxygen is stoichiometrically related to the amount of carbon in the halocarbon. The amount of $SiCl_4$ is similarly stoichiometrically related to the amount of fluorine in the halocarbon, it being remembered that one mole of $SiCl_4$ will approximately accept the fluorine from two moles of $C_2Cl_2F_2$ in forming $SiF_4$. However, it is desired to have a slight excess of the fluorine acceptor in order to prevent a substantial formation of $CF_4$ and it is hence desired that the fluorine acceptor be present in an amount ranging from about 10 to 30% above that stoichiometrically required to react with the fluorine in the fluorocarbon. Typically, on a volume basis employing argon, $C_2Cl_2F_2$ and $SiCl_4$, the respective ratios are 5 to 10:1 for argon:$C_2Cl_2F_2$ and 20:1 to 30:1 for argon:$SiCl_4$. Obviously, all the gases should be relatively dry and not carry moisture into the molten metal treatment process where moisture is considered deleterious. If any of the gases are not sufficiently dry, a desiccator can be employed to get the dew point down to the desired level.

An alternative embodiment to that depicted in the FIGURE involves the use of silica ($SiO_2$) as a source of both the oxygen and silicon. That is, the silica can provide both the oxidizer and the fluorine acceptor. In this arrangement the halocarbon containing fluorine is simply passed over the silica at a temperature of 1300° F. or higher. One suitable location for the silica is in the conduit 50 above the carbon bed 48. Thus, according to this embodiment, the argon and $C_2Cl_2F_2$ are simply passed down through the conduit 50 where they first contact the silica and then the carbon bed 48. While this particular embodiment offers certain potential advantages in simplicity, it obviously involves use of a solid material as a reactant rather than a vapor such as $SiCl_4$ and, accordingly, suffers from some inconvenience, thus rendering the arrangement shown in the FIGURE somewhat preferred from the standpoint of convenience in the practical sense.

While there is only a single reaction chamber shown in the FIGURE, it should be understood that two or three or even more such chambers can be arranged in sequence along the general lines depicted in U.S. Pat. No. 3,839,019, incorporated herein by reference. Thus, metal can be treated in a first chamber of the type shown in the drawing and passed under a baffle into a second similar chamber and then passed over a baffle into a third such chamber, and so on in sequence, although in general two or three chambers are often sufficient. As also shown in said U.S. Pat. No. 3,839,019 suitable baffles can be provided to facilitate separation of floatable phases out of the molten metal into an overlying layer. In practicing the invention, however, such a layer simply serves to dispose of such phases and is not required. That is, the present invention is practiced without need of an overlying salt layer, although such a salt layer could form if significant amounts of $MgCl_2$, a liquid, should form. For the most part, however, little, if any, such phase is formed and hence, little, if any, salt layer is formed since most of the salt products are tied up by the fluorides to behave essentially like solids. Thus, there is but a miniscule amount of $MgCl_2$ liquid formed which easily rises out of the melt and in fact is of some benefit in suppressing skim formation.

Separation of the fluoride-containing salt phases is readily accomplished in a filter such as a bed of the type shown in U.S. Pat. Nos. 3,039,864 and 3,737,305, both of which are incorporated herein by reference. Such arrangements have been employed in treating molten aluminum for a number of years and have enjoyed substantial success. The processes depicted in said patents also include the passage of gas through the molten metal which can be utilized for still further treatment where such is desired. Hence, one aspect of the improvement includes passing the molten metal treated in accordance with the improvement through a filter bed of nonreactive bodies, such as alumina, which can be of relatively small particle size, such as $-3+14$ mesh, all as shown in said patents. In such a bed, it is preferred to utilize further gas treatments as specified in U.S. Pat. Nos. 3,039,864 and 3,737,305. Argon or other nonreactive gas, with or without a reactive halogenaceous gas such as chlorine, is contacted with the molten metal moving through the bed to further beneficiate the metal. In such a treatment, the amount of nonreactive gas typically exceeds the amount of chlorine or other reactive gas.

EXAMPLE

The improvement was employed in treating several aluminum alloys containing substantial amounts of magnesium. These are the alloys which can give rise to the oxide patch problem caused by magnesium-containing salts. The alloys treated included Aluminum Alloy 5042 containing about 4–5% Mg and 0.2–0.5% Mn, Aluminum Alloy 5182 containing about 4–5% Mg and 0.2–0.5% Mn and Aluminum Alloy 5082 containing about 4–5% Mg. Of course, these alloys contain the normal amounts of incidental elements and impurities normally found in aluminum alloys of this type, along with the alloying additions just specified. In the system employed, two, or in some cases three, agitated reaction chambers of the general type shown in U.S. Pat. No. 3,839,019 were employed in sequence followed by treatment in a filter bed as shown in U.S. Pat. No. 3,737,305 through which a mixture of argon, containing about 4% (by vol.) chlorine was passed. In the reaction chambers, a mixture of argon and $CCl_2F_2$ was employed in a volume ratio of about 5:1 in favor of argon for the first two chambers and at about 10 or 11:1 in the third chamber where the third chamber was employed. In those runs employing just the argon-halocarbon mixture and not practicing the invention, the life of the filter bed enabled processing about 4,000,000 pounds of aluminum. At this point, the bed started to plug apparently because of an accumulation of aluminum carbide inclusions in the bed. Still further, carbides built up at the disperser-agitator, which in some instances had to be replaced after processing as little as 200,000 pounds of aluminum.

The agitators were modified as shown in the FIGURE to provide the hollow space 50, and oxygen and silicon tetrachloride were employed in accordance with the improvement. The volume ratio of argon to $CCl_2F_2$ remained at about 5:1 for the first two chambers and at 10 or 11:1 for the third, when used. The volume ratio of $CCl_2F_2$ to oxygen was about 9:1 in favor of $CCl_2F_2$, and the volume ratio of argon to $SiCl_4$ was about 20:1 in favor of argon for the first two chambers and 30:1 for the third reaction chamber, when used. Again, the filter bed in accordance with U.S. Pat. No. 3,737,305 was employed since such not only removes salt particles, but further beneficiates the improvement and, accordingly, the use of such a bed in combination with the arrangement of the FIGURE is a preferred embodiment of the invention. In this arrangement, over 28,000,000 pounds of aluminum were processed with no significant degradation either in the subsequent filtering operation or at the agitator. The operation was interrupted for reasons having nothing to do with impairment of the system, clearly demonstrating an improvement of sevenfold, thus verifying the effect of the improvement in avoiding the formation of carbides in treating molten aluminum with halocarbons. In all of the runs, both those employing the improvement and the other runs, the sodium content of the metal was reduced from about 0.002 to less than 0.0002 wt.%, and the calcium content was reduced from about 0.001 to less than 0.0001 wt.%, thus demonstrating that the present improvement is achieved at no expense whatsoever in the effectiveness of fluoridizing the sodium and calcium impurities.

The invention is described with respect to treating molten aluminum but is considered valuable in treating other metals with halocarbons, especially halocarbons containing fluorine, particularly where the treated metal contains halogenizable metallic impurities, for instance dissolved chloridizable or fluoidizable metal impurities. The invention should be useful in treating the so-called light metals, aluminum and magnesium, or any of various metals beneficiated by treatment with halocarbons, especially metals which react or combine with carbon constituent in the halocarbon or containing elements combining or reactive therewith, particularly where such act to the detriment of the metal treated or the treatment process.

While the invention has been described in terms of preferred embodiments, the claims appended hereto are intended to encompass all embodiments which fall within the spirit of the invention.

What is claimed is:

1. In a process for treating molten metal wherein said metal is contacted with halogen values from a gas containing a halocarbon the improvement comprising contacting said halocarbon with an oxidizer under conditions to oxidize carbon constituent thereof prior to introducing said halogen values into the molten metal.

2. In a process for treating molten metal wherein said metal is contacted with fluorine values contained in a halocarbon containing fluorine the improvement comprising contacting said halocarbon with an oxidizer under conditions to oxidize substantial portions of the carbon therein to carbon monoxide and with a fluorine acceptor to impede contacting the molten metal with $CF_4$ and favor oxidation of carbon to CO, said fluorine acceptor yielding fluorine values for treatment of said molten metal.

3. In a process for treating molten metal wherein said metal is contacted with halogen values from a gas comprising a halocarbon, the improvement comprising reacting carbon in said halocarbon to produce a carbonaceous reaction product more stable in the treatment process than said halocarbon, but non-deleterious to said metal and said treatment process, prior to contacting said metal with said halogen values.

4. The improvement according to claim 1 wherein said oxidizer comprises oxygen.

5. The improvement according to claim 1 wherein said oxidizer comprises oxygen provided in an amount stoichiometrically related to the carbon in said halocarbon.

6. The improvement according to claim 2 wherein said fluorine acceptor comprises silicon.

7. The improvement according to claim 1 wherein a nonreactive gas is employed in said process in an amount greater than said halocarbon.

8. The improvement according to claim 2 wherein a nonreactive gas is employed in said process in an amount greater than said halocarbon.

9. The improvement according to claim 1 wherein a nonreactive gas is employed in said process in a volume ratio of at least 2:1 with said halocarbon.

10. The improvement according to claim 2 wherein a nonreactive gas is employed in said process in a volume ratio of at least 9:1 with said halocarbon.

11. The improvement according to claim 2 wherein said fluorine acceptor comprises silicon provided as $SiCl_4$.

12. The improvement according to claim 2 wherein said fluorine acceptor comprises silicon provided as $SiO_2$.

13. The improvement according to claim 1 wherein said oxidizer is oxygen used in an amount stoichiometrically in excess of that required to oxidize the carbon in said halocarbon to CO by up to about 30% excess whereby some $CO_2$ is formed and said $CO_2$ is passed over carbon at an elevated temperature prior to introduction into said molten metal.

14. The improvement according to claim 1 wherein said halocarbon contains fluorine.

15. The improvement according to claim 1 wherein said halocarbon contains fluorine and is contacted with a fluorine acceptor to impede production of $CF_4$ and favor said oxidation of said carbon.

16. The improvement according to claim 2 wherein said fluorine acceptor's fluoride is more stable than $CF_4$ and the oxide of said acceptor.

17. The improvement according to claim 16 wherein said fluorine acceptor's fluoride is gaseous.

18. The improvement according to claim 16 wherein said fluorine acceptor's fluoride is less stable than the fluoride of one or more metals present in the molten metal being treated.

19. The improvement according to claim 1 wherein said molten metal comprises aluminum or the alloys thereof.

20. The improvement according to claim 2 wherein said molten metal comprises aluminum or the alloys thereof.

21. The improvement according to claim 2 wherein said oxidizer is oxygen used in an amount stoichiometrically in excess of that required to oxidize the carbon in said halocarbon to CO by up to about 30% excess whereby some $CO_2$ is formed and said $CO_2$ is passed over carbon at an elevated temperature prior to introduction into said molten metal, said excess of oxidizer not being in excess of that required to oxidize all the carbon to $CO_2$.

22. A process for treating molten aluminum with reactive fluorine values in a fluorocarbon gas comprising:

(a) contacting said fluorocarbon with oxygen to oxidize carbon values therein to one or more carbon oxides, said oxygen being provided in excess of the stoichiometric equivalent to react said carbon values to CO, but insufficient to react all said carbon values to $CO_2$, thereby forming both CO and $CO_2$;

(b) contacting said fluorine values with a fluorine acceptor to substantially impede introduction of $CF_4$ to the molten aluminum;

(c) combining said fluorine values with a nonreactive gas, the amount by volume of said nonreactive gas exceeding the amount of said fluorine values as gas to form a mixture of said gases; and (d) introducing said gas mixture into said molten aluminum.

23. The improvement according to claim 22 wherein said fluorine acceptor comprises silicon.

24. The improvement according to claim 22 wherein said $CO_2$ is passed over carbon before introduction into said molten aluminum.

25. The improvement according to claim 22 wherein said fluorine acceptor's fluoride is gaseous and less stable than the fluoride of one or more metals contained in said molten aluminum.

26. A process for treating molten aluminum with reactive fluorine values in a fluorocarbon gas comprising:

(a) contacting said fluorocarbon with oxygen, $SiCl_4$ and a nonreactive gas;

(b) providing a treatment chamber for said molten aluminum including therein a rotating agitator having a hollow shaft therein to provide a hollow space in said shaft, said hollow space being provided with an exit in the region of said agitator;

(c) introducing said fluorocarbon, oxygen, $SiCl_4$ and nonreactive gas into the said hollow space in said agitator shaft;

(d) heating said gases in said agitator shaft to a temperature exceeding 1000° F.;

(e) said oxygen being provided in an amount stoichiometrically in excess by 10 to 30% of the amount required to react the carbon constituent in said fluorocarbon to CO, thereby to react said carbon values to form both CO and $CO_2$;

(f) said $SiCl_4$ combining with said fluorine values to form substantial amounts of $SiF_4$ and $Cl_2$ while substantially reducing the amount of $CF_4$ which would enter the molten aluminum but for the action of said $SiCl_4$;

(g) moving said carbon oxides, fluorine values, chlorine and nonreactive gas through a reducing media to reduce the substantial portions of said $CO_2$ to CO;

(h) passing said gases from said hollow chamber into said molten aluminum.

27. The improvement according to claim 1 wherein the carbonaceous-oxidizer reaction product is gaseous.

28. The improvement according to claim 2 wherein the carbonaceous-oxidizer reaction product is gaseous.

29. The improvement according to claim 1 wherein said oxidation reaction is substantially effected before the halogenaceous values in said halocarbon contact the molten metal.

30. The improvement according to claim 2 wherein said oxidation reaction is substantially effected before the halogenaceous values in said halocarbon contact the molten metal.

31. The improvement according to claim 1 wherein said halocarbon and said oxidizer react within a hollow portion of a rotating agitator shaft prior to introduction into said molten metal.

32. The improvement according to claim 2 wherein said halocarbon and said oxidizer react within a hollow portion of a rotating agitator shaft prior to introduction into said molten metal.

33. The improvement according to claim 1 wherein said molten metal, after said treatment with said halocarbon, is moved through a filter bed.

34. The improvement according to claim 2 wherein said molten metal, after said treatment with said halocarbon, is moved through a filter bed.

35. The improvement according to claim 22 wherein said molten metal, after said treatment with said halocarbon, is moved through a filter bed.

36. The improvement according to claim 26 wherein said molten metal, after said treatment with said halocarbon, is moved through a filter bed.

37. The improvement according to claim 1 wherein said molten metal contains halogenizable metal impurities which are reacted with said halogen values in said process.

38. The improvement according to claim 2 wherein said molten metal contains fluoridizable metal impurities which are reacted with said fluorine values in said process.

* * * * *